United States Patent [19]

An

[11] Patent Number: 4,671,044

[45] Date of Patent: Jun. 9, 1987

[54] AUTOMATIC PROFILE WEB FILLER

[75] Inventor: Hung D. An, Clayton, Australia

[73] Assignee: ACI Australia Limited, Melbourne, Australia

[21] Appl. No.: 871,433

[22] PCT Filed: Sep. 3, 1985

[86] PCT No.: PCT/AU85/00213

§ 371 Date: May 5, 1986

§ 102(e) Date: May 5, 1986

[87] PCT Pub. No.: WO86/01485

PCT Pub. Date: Mar. 13, 1986

[30] Foreign Application Priority Data

Sep. 5, 1984 [AU] Australia ..... PG6960

[51] Int. Cl.[4] ..... B65B 43/34; B65B 9/08; B65B 7/06; B65B 51/14

[52] U.S. Cl. ..... 53/468; 53/469; 53/477; 53/481; 53/570; 53/266 R; 53/373; 141/10; 141/114

[58] Field of Search ..... 53/570, 473, 467, 469, 53/481, 477, 575, 373, 266 R, 459, 468; 141/10, 114

[56] References Cited

U.S. PATENT DOCUMENTS

| | | | |
|---|---|---|---|
| 3,492,783 | 3/1970 | Dohmeier | 53/570 X |
| 3,583,127 | 6/1971 | Marchand | 53/570 X |
| 3,618,286 | 11/1971 | Membrino | 53/570 X |
| 3,673,765 | 7/1972 | Dohmeier et al. | 53/570 |
| 3,699,746 | 10/1972 | Titchenal et al. | 53/570 |
| 3,746,056 | 7/1973 | Titchenal et al. | 53/570 X |
| 3,813,845 | 6/1974 | Weikart | 53/469 |
| 4,248,032 | 2/1981 | Woods et al. | 53/570 |
| 4,514,962 | 5/1985 | Ausnit | 53/570 X |
| 4,534,154 | 8/1985 | Gaubert | 53/570 X |

FOREIGN PATENT DOCUMENTS

| | | | |
|---|---|---|---|
| 82141 | 12/1976 | Australia . | |
| 2010359 | 9/1971 | Fed. Rep. of Germany . | |
| 2328998 | 1/1974 | Fed. Rep. of Germany | 53/570 |
| 2804700 | 8/1979 | Fed. Rep. of Germany . | |
| WO82/00129 | 1/1982 | World Int. Prop. O. . | |
| WO84/01351 | 4/1984 | World Int. Prop. O. . | |

*Primary Examiner*—Horace M. Culver

*Attorney, Agent, or Firm*—Merchant, Gould, Smith, Edell, Welter & Schmidt

[57] ABSTRACT

Apparatus for and a method of filling a chain of successively connected bag containers, each closed at its bottom end with successive ones seamed at adjacent side edges, the chain defining sleeve means along the upper edge thereof, above said side seams. The invention comprises moving the chain of containers along a process line, from a source thereof to a discharge point, with said sleeve means uppermost, past a filling station having a filling head operable to charge flowable material received from a source thereof, from a filling nozzle of the filling head, into successive containers presented to the filling station and past a sealing station which is intermediate the sealing station and discharge point, the sealing station having sealing means for sealing the top of each filled container. The sleeve means is received onto a mandrel having a transverse bore at the filling station, the chain of bags is indexed along said process line, and the discharge nozzle moved in synchronism with indexed movement of the chain between an advanced position in which is projects into said transverse bore of the mandrel to fill a container and retracted position.

29 Claims, 9 Drawing Figures

AUTOMATIC PROFILE WEB FILLER

This invention relates to a method of, and apparatus for, filling bag containers with a flowable material.

A number of prior art proposals relate to the filling of bag containers provided in a continuous chain of containers connected in side-by-side relation. Such prior art includes U.S. Pat. Nos. 3,492,783; 3,618,286; 3,699,746 and 3,813,845 and International Patent applications Nos. PCT/SE81/00187 (WO 82/00129) and PCT/SE83/00335 (WO 84/01351).

Each of those prior art proposals is subject to a number of disadvantages. In the case of U.S. Pat. No. 3,492,783, the chain of bags to be filled is essentially unsupported, either laterally or at its upper edges, over substantially the full length of the apparatus. There thus is little overall control in the event of collapsing or lateral displacement of a bag, such as can occur due to a loss of tension along the chain or due to asymmetrical filling of a bag.

In U.S. Pat. No. 3,618,286, the bags are supported on a mandrel means which is received through a continuous or discontinuous sleeve or loop menas defined along the upper edge of the chain of bags. In a first arrangement, the mandrel means comprises two lengths of a pipe which, over a major portion of their length to each side of a filling hopper, are in close side-by-side relation but which, below the hopper, are more widely spaced to spread the top of each bag in turn for filling. In that first arrangement, the sleeve or loop means comprises a respective loop between each successive pair of bags, or a sleeve which is slit immediately prior to the filling hopper to provide such respective loops. In a second arrangement of U.S. Pat. No. 3,618,286, the mandrel is a solid bar which terminates short of the feed hopper, with the sleeve or loop means being a sleeve which is fully slit along each bag as the latter is presented to the hopper. In the first arrangement, support for each bag when filled is provided solely by a respective loop at each end of its upper edges; with rupture of the loops being likely where the pipe lengths are spaced more widely below the feed hopper. In the second arrangement, the disadvantages are essentially the same as for U.S. Pat. No. 3,492,783.

The arrangement of U.S. Pat. No. 3,699,746 is somewhat akin to the second arrangement of U.S. Pat. No. 3,618,286. That is, a chain of bags which are closed, but define a sleeve along the upper edge thereof. The sleeve is received onto a mandrel which terminates short of a hopper; the sleeve being continuously cut as presented to a knife adjacent the hopper and the resultant free-edges of successive bags are gripped against the hopper by a first pair of endless belts. After filling, the bag tops are gripped between a second pair of endless belts which move the bags at an increased speed and so separate successive filled bags prior to them being presented to a sealing station.

The first and second pairs of endless belts by which the tops of successive bags are gripped in the arrangement of U.S. Pat. No. 3,699,746, particularly given the provision of respective endless belts supporting the bags during and after filling, largely overcome the problems of supporting the bags as detailed in relation to U.S. Pat. Nos. 3,492,783 and 3,618,286. However, this is at the expense of the need for several endless belt systems which add to the complexity and cost of the apparatus. Also, in the case of U.S. Pat. No. 3,699,746 there is the problem of providing a respective drive for the belt system and in synchronising these. Additionally, in all three of those U.S. specifications, the arrangements disclosed principally are suitable for packaging solids of a non-flowable nature, rather than liquids and flowable pastes, or readily flowable particulate or powdery materials.

U.S. Pat. No. 3,813,845 is concerned with an arrangement for packaging liquids, but which is less well suited to the packaging of pastes and even less so to the packaging of flowable particulate or powdery material. This arrangement has some similarity to that of U.S. Pat. No. 3,699,746 and the second arrangement of U.S. Pat. No. 3,618,845, in that the chain of bags has a sleeve along its upper edge which is received onto a mandrel means. However, in this instance, the latter is a filling pipe along which a liquid to be packaged is passed from the bag discharge end of the apparatus; the liquid discharging from the remote end of the pipe into successive bags of the chain. After passing beyond that remote end of the pipe, but while still suspended on the latter by its sleeve, each bag is heat sealed across its top, below its sleeve and the pipe.

The arrangement of U.S. Pat. No. 3,813,845 obviates the complexity of the above-detailed prior art in supporting the bags prior to, during and after filling. That is, the bags are simply suspended by the sleeve on the filling pie; although support is augmented by an endless belt below the chain of bags. Also movement of the chain of bags is, as a result, able to be simplified in that this can essentially be by means of drive rollers which frictionally engage the sleeve on the filling pipe at the discharge end of the apparatus; while the filled and sealed bags are able to be cut free from the sleeve at that end. However, the apparatus of U.S. Pat. No. 3,813,845 necessitates a complex arrangement of metering plates between which successive bags are supported while being filled, so as to control the volume of liquid charged thereto; with the control provided by such plates being relatively insensitive. Also, the discharge of liquid into successive bags of the chain will result in the surfaces of each bag which are to be heat sealed being contaminated, so that heat sealing will be extremely difficult or impossible to effect. This latter problem, of course, will be exacerbated where the chain of bags rises to the discharge end of the apparatus so that excess liquid charged to one bag overflows to the next bag.

PCT/SE81/00187, and PCT/SE83/00335 in so far as relevant to the present matters, disclose in a sense a variant of the arrangement of U.S. Pat. No. 3,618,286, in that a mandrel means comprising two pipe lengths are used. However, each pipe length is received in a respective sleeve in each wall of the chain of bags. Apart from limitations or disadvantages such as discussed in relation to U.S. Pat. No. 3,618,286, the arrangement of these International specifications has the further practical and cost disadvantages arising from the need to form such respective sleeves.

The present invention is directed to providing an improved method of, and apparatus for, filling bag containers with a flowable material.

The invention provides apparatus for filling a chain of successively connected bag containers, each container of the chain being closed at its bottom end, with successive containers being joined at adjacent side edges at which each is sealed by a seam along a major portion of the height thereof, the chain of said containers defining sleeve means along the upper edge thereof, above said side seams; said apparatus comprising:

(a) means for moving said chain of containers along a process line, from a source thereof to a discharge point, with said sleeve means uppermost;

(b) a filling station at a first location along the process line, the filling station having a filling head operable to charge flowable material received from a source thereof, from a filling nozzle of the filling head, into successive containers presented to the filling station;

(c) a sealing station at a second location along the process line, which second location is intermediate the first location and the discharge point, the sealing station having sealing means for sealing the top of each filled container presented thereto after movement of the container from the filling station; and (d) a mandrel extending along the process line and onto which the sleeve means is receivable, the mandrel having a transverse bore located at the filling station;

the moving means being operable to index the chain of bags along the process line, and the discharge nozzle being movable, in synchronism with indexed movement of the chain of containers, between an advanced position in which it projects into the transverse bore of the mandrel for filling a container received at the filling station and retracted position.

Preferably, the chain containers used in the invention is of an improved form. While the following description essentially is with reference to that form, it is to be understood that other container chains can be used in at least some embodiments of the invention. Thus, container chain such as disclosed in relation to FIGS. 1 to 8 of U.S. Pat. No. 3,618,286 can, for example, be used.

In the improved form of chain of containers, each container defines a body for receiving material to be packaged therein, with the sleeve means being in communication with the body of each container via an opening which is a minor proportion of the width of the container in the direction of the sleeve means. That is, the sleeve is of substantially complete tubular form across a major portion of the top of each container, such as by a weld band joining opposed walls of the chain of containers along a line substantially parallel to, but spaced from the upper edge of the chain. Each container may have a single such weld band, which extends from one side seam but terminates short of the other side seam to define the opening to the container body. Alternatively, a respective such weld band may extend inwardly from each side seam, with the opening being defined between the inner ends of the weld lines. The or each weld band may be of a width enabling separation of each container from the sleeve means by a knife edge forming a cut therealong. Alternatively, each weld band may comprise a closely spaced pair of weld lines, between which such knife edge can act to effect such separation. Where such parallel weld lines are provided, these preferably are joined at their ends at the opening providing communication between the sleeve means and the container body.

In such improved form of chain of containers, the means for moving the chain along the process line is operable to index the chain to locate the opening to the body of successive containers in register with one end of the bore of the mandrel. Thus, when the filling nozzle is moved to its advanced position, with a container opening so located, material to be packaged is able to be charged into the container body.

The sleeve means may have a plurality of openings preformed therein, with each opening diametrically opposed to the inlet of a respective container. Thus, with a container located with its inlet in register with one end of the mandrel bore, the opposed opening is in register with the other end of the bore. The nozzle thus is able to move to its advanced position through that opening, into the bore, and preferably into the container inlet. However, such openings need not be preformed, in which case the nozzle is adapted to form such opening on movement to its advanced position by punching through, or forming a cut-out in, the sleeve means.

The filler head nozzle may be of elongate tubular form. The nozzle preferably has a plunger movable axially therein between a position in which the plunger closes an outlet of the nozzle, and a retracted position clear of that outlet to permit discharge of liquid to a container. Such plunger may be movable under the action of a ram, of which the plunger can form the piston rod. Such ram may be single acting and operable against the action of biasing means urging the plunger to its closed position, or it may be double acting.

The nozzle may project through the bore of the mandrel, when in its advanced position. In such case, the filling head may include gripping means for engaging the walls of successive containers and securing each container in turn in relation to the filling nozzle. Thus, the gripping means may comprise at least one block member, such as a resilient block, movable between a retracted position and a position in which it clamps the container wall against the nozzle. The or each such block member may be movable under the action of actuator means, such as a cam member operable to move the block member to its clamping position against the action of means which biases that member to its retracted position.

The filling head nozzle may be movable between its advanced and retracted positions under the action of an actuator means, such as a hydraulic or pneumatic actuator. Most conveniently, the actuator means is a rodless cylinder, such as an ORIGA pneumatic cylinder.

The filling station may include control means enabling operation of one or more of the components thereof. Thus, the control means may include means for energizing a device, such as an electric motor, controlling operation of a pump for supplying flowable material to the filling station and/or control devices, such as solenoids, for controlling operation of actuators of the filling head nozzle, such as the actuator for the nozzle plunger and the actuator for moving the filling head nozzle itself. Also, while the above-described cam member for moving the gripping means may be manually operable, it can alternatively be operated by an actuator energized by the control means.

Material with which a container is to be filled may pass to the nozzle from a suitable source, via a supply line. Flow measuring means, such as a turbine flow meter, can be provided in that line and operated under the action of the flow to generate a signal which is passed to the control means. By monitoring that signal, the control means may be operable to terminate a filling operation when a predetermined quantity of material has been charged to a container. Additionally, the control means may have readout means, such as an L.E.D. display, to provide an indication of that quantity for successive individual containers and/or an aggregate quantity for successive containers.

The sealing means may include a welding block and a pressure block; the blocks being relatively movable between a retracted position in which to receive the inlet of successive containers therebetween and a closed position for effecting a heat sealing operation across that opening. Supply of electric power to, and resultant heating of, the welding block enables sealing of the container opening.

In one arrangement, the sealing means includes a first pressure block and a welding block in opposed relation and, adjacent the welding block, a second pressure block. With a container received between the first welding block on the one hand and the second block on the other hand, the pressure blocks are brought into their closed position to grip the container adjacent its inlet, and the welding block is moved to its closed position in which it and the first pressure block grip the container across its inlet and a weld is formed across the inlet. The welding block then is retracted and, after cooling of the weld, the pressure blocks are retracted to release the container. One of the pressure blocks may have mounted thereon air jetting means positioned, on actuation of valve means, to apply a cooling air jet from a pressurized source thereof, over the weld, to cool the latter prior to retraction of the pressure blocks.

The sealing station may include actuator means for effecting relative movement between the welding block and the pressure block, or between the welding and first and second pressure blocks. In one arrangement, the actuator means may be at least one hydraulic or pneumatic ram, such as a single acting ram operable against the action of biasing means urging the blocks to their retracted relative position, or a double acting ram.

The above mentioned, or a further, control means may be provided to control operation of the sealing means. In one convenient arrangement, the control means is operable to provide time-controlled actuation of energizing means enabling a sealing operation to be performed. Thus, the control means may be operable to energize a control device, such as a solenoid, to effect relative movement between the welding and pressure blocks to their closed position for sealing of the opening of a container received between those blocks. The control means also may be operable to actuate a power source for heating of the welding block for a predetermined interval and, after a predetermined further interval sufficient for cooling of a resultant sealing weld, to permit movement of the blocks to their retracted position. Alternatively, the weld block may be continuously heated and so of constant heat. The control means also may provide time controlled actuation of the valve means for applying cooling air.

The mandrel may be an elongate bar, rod or tube extending in the direction in which the containers move from the filling, to the sealing, station. In the case of a tubular mandrel, its bore preferably is defined by a cylindrical insert; while the leading end of the tube may be closed. The mandrel may have a receiving end adjacent the filling station for receiving thereon the sleeve means of the chain of containers. The mandrel principally serves to guide the containers between those stations. However, the mandrel most conveniently extends beyond the filling station away from the sealing station so that the containers are guided by the mandrel to the filling station.

The mandrel may be provided with rolling means at one or more locations along its length which assist movement of the chain of container. The rolling means at the or each location may include at least one roller mounted on the mandrel. In one convenient arrangement, the rolling means may comprise a plurality of rollers spaced circumferentially around the mandrel. The or each roller preferably has its axis of rotation perpendicular to the longitudinal extent of the mandrel. The or each roller may be set into the mandrel, such as within a respective pocket formed in the surface of the mandrel.

As indicated above, the sleeve means of the chain of containers need not have a respective preformed opening opposite each container inlet. Thus, the filling head nozzle may rupture the sleeve means on movement to its advanced position, or it may be provided with a cutting edge forming such opening during such movement, to form a cut-out from the sleeve means. In the latter case, the cutting edge may be shaped such that the cut-out remains attached to the periphery of the opening and can not be displaced into the container; the cutting edge, for example, being penannular.

The mandrel may extend beyond a side of the sealing station remote from the filling station. Where those stations are of the above described forms, the mandrel most conveniently extends intermediate the filling head nozzle, when retracted, and the filling head gripping means. The mandrel also most conveniently extends past the sealing station such that the latter is at the same side of the mandrel as the filling head gripping means; this being the side of the mandrel to which the container body extends.

The apparatus may include means for supporting successive containers at the filling and sealing stations and in movement from the former to the latter station. The support means may comprise a support platform on which a container to be filled is receivable. Most conveniently, such platform is inclined downwardly from the filling and sealing stations such that a container can be positioned with its inlet above the body of the container. One highly suitable form of platform is a roller tray, comprising a plurality of rotatable rollers laterally spaced in the direction of the process line from the filling to the sealing station, and having their axes inclined downwardly from those stations.

While support means is provided in one form of the invention, such means need not be provided in alternative forms. Thus, successive containers when presented to the filling and sealing statiosn and moved from the former station, to and beyond the latter, can be supported by the mandrel means. With the sleeve means of the chain of containers received on the mandrel, the containers may simply depend below the mandrel.

As the chain of containers moves from the filling station to the sealing station, it is prevented from departing from its line of movement along the process line by its sleeve means being received on the mandrel. However, once a container has been filled, its sleeve means has served its purpose in this regard, and the sleeve means can be separated from the body of the filled container. For such separation, severing means can be provided at the sealing station or at the side of that station remote from the filling station. The severing means may comprise a blade which has a cutting edge extending along the full extent of the sleeve means of a single container and movable normal to that edge to separate the sleeve means while the container inlet still is held at the sealing station. Alternatively, the severing means may be a blade having cutting edge extending normal to the direction of movement of the chain of containers, and in a position to separate the sleeve means of a filled container as the latter is moved in that direction after release from the sealing station. In the former case, the blade may be movable with one of the blocks of the sealing station, or by operation of a further actuator such as a ram. In the latter case, the blade may be fixed and engaged by the sleeve means being drawn thereto. In each case, the severing means most conveniently is located to form a cut on a line extending intermediate the mandrel and the blocks of the sealing station. Where the sleeve means is a sleeve separated from the body of the container by a weld of a first series thereof, as described above, the line may extend within the lateral extent of that weld or between a pair of seams comprising that weld.

The apparatus may have container supply means. The supply means may comprise a mounting, beyond the mandrel receiving end and adjacent the sealing station, for holding a roll of a chain of inter-connected containers to be filled. The containers may be drawn from the roll and the sleeve means of the first container passed onto the mandrel, after which the sleeve means at successive container is drawn onto the mandrel.

The means for moving or progressing the chain is operable to draw the chain, by indexed movement, to present successive containers in turn to the filling and sealing stations. Most conveniently, the spacing between those stations is as integral multiple of the spacing between the inlets of successive containers; with the progression means being operable to provide indexed movement equal to that spacing. The progression means may comprise at least one one roller means motorized for intermittent frictional drive to draw the chain of containers. Such roller means may comprise a friction roller located adjacent the mandrel, such as at the side of the sealing station remote from the filling station, such that the sleeve means is frictionally engaged between the friction roller and the mandrel. Intermittent drive of the friction roller thus is operable to draw the sleeve means along the mandred by indexed movement, and similarly to move the chain of containers.

It is necessary that the sleeve means be releasable from the mandrel, and this can be achieved by cutting of the guide means by the above mentioned severing means, or by a further severing means. Thus, the sleeve means preferably is not only separated from the body of successive containers, but also is slit longitudinally so it can be drawn from the mandrel. Drawing of the sleeve means from the mandrel enables use of alternative forms of movement means for moveing the chain of containers.

In a first alternative, the movement means comprises "nip" rollers between which the sleeve means is received on release from the mandrel. Such rollers are motorized for intermittent frictional drive to draw the sleeve means by indexed movement, and similarly to move the chain of containers. In a second alternative, the movement means may comprise a linear actuator, such as a pneumatic or hydraulic cylinder, and having releasable gripping means movable between an advanced and a remote position. Such actuator may be operable, in its advanced position, to grip the sleeve means at or after the location at which the latter is released from the mandrel, to draw the sleeve means and containers along the mandrel on movement to its remote position, and to ungrip the sleeve means when at the latter position. Return of the actuator to its advanced position enables its gripping means to grip the sleeve means at a fresh position, and repeat the operation to provide indexed movement.

Where the apparatus includes support means, the filler head of the filling station may be operable to discharge material into the containers in a substantially horizontal direction. Such direction may in fact be horizontal, or it may be at a relatively small angle, for example from 10° to 20° to the horizontal, such as to be substantially parallel to the inclination of a platform comprising the support means and inclined downwardly from the filling and sealing stations. Also, where support means is provided, relative movement of blocks of the sealing means may be in a substantially vertical direction, for example, substantially normal to a platform comprising the support means. However, where support means is not included, such respective directions of movement of these components of the filler head and sealing station each may be varied through substantially 90°, the filler head most preferably being operable from above the containers.

Reference now is made to the accompanying drawings, in which.

Figure 1:
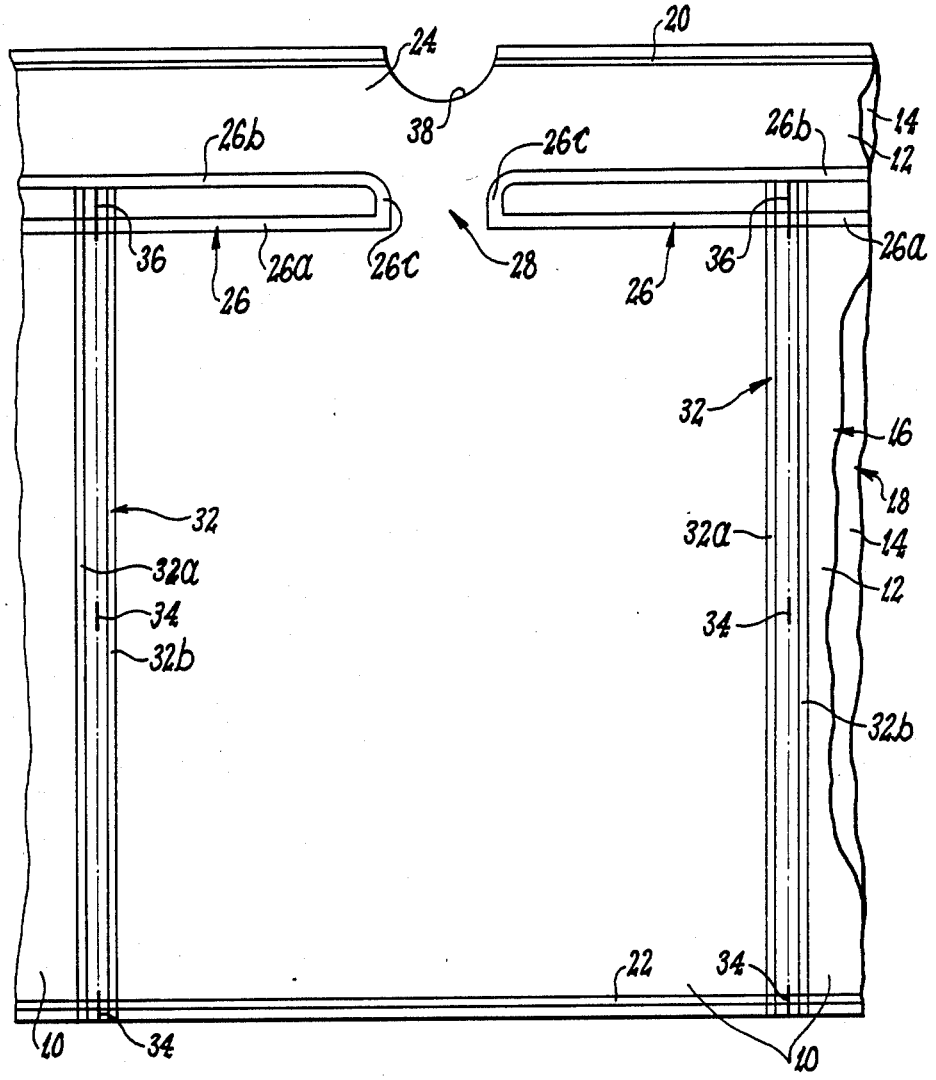
FIGS. 1 and 2 show respective forms of containers.
Figure 2:
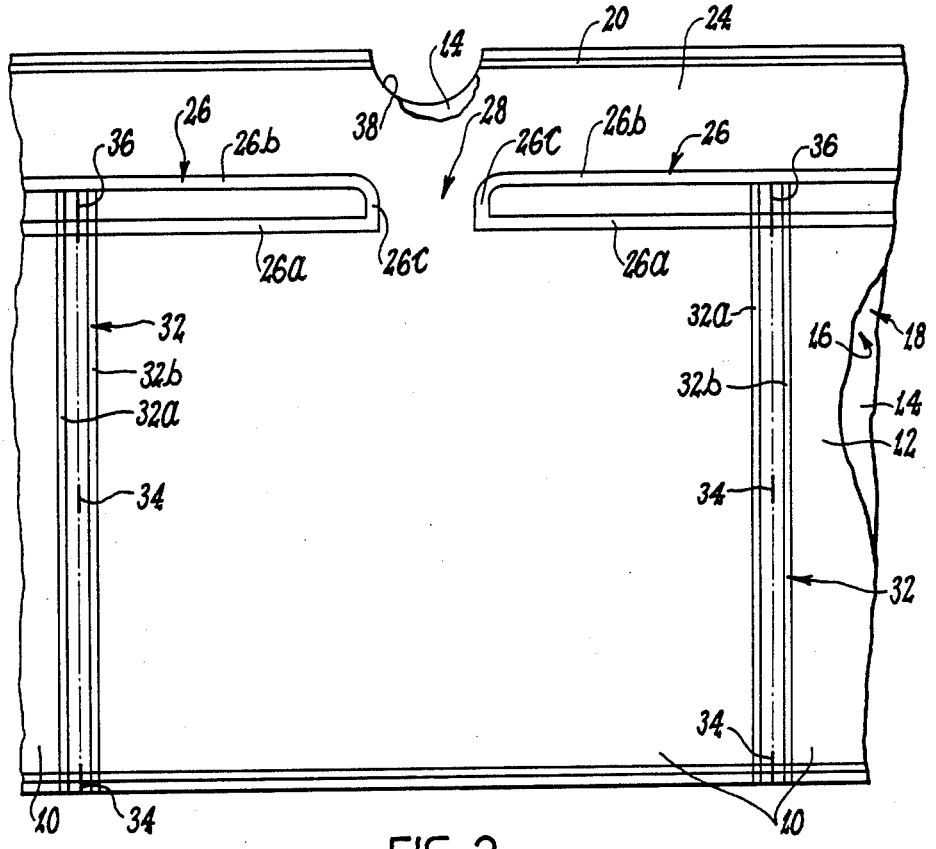

With reference to FIGS. 1 and 2, the respective containers 10 have superimposed walls 12, 14 provided by the heat sealing together, at adjacent longitudinal edges, of upper and lower strips 16, 18 of plastics film. The heat sealing forms top and bottom weld seams 20, 22.

A relatively narrow sleeve means on guide sleeve 24 is defined between walls 12, 14, seam 20 and a discontinuous series of welds 26 formed parallel to seam 20, such that sleeve 24 extends across the top of a chain of successive containers. For each container, an inlet 28 to the body 30 thereof is defined between adjacent ends of successive welds 26. Also, the welds 26 are defined by a parallel pair of seams 26*a*, 26*b* which are joined by seam section 26 at inlet 28.

Body 30 of each container 10 is defined between walls 12, 14 by welds 26, bottom seam 22 and side welds 32. As shown, each seam 32 extends perpendicularly between a respective weld 26 and seam 22. Also, each weld 32 is defined by a parallel pair of seams 32*a*, 32*b*. Between the seams 32*a*, 32*b* of each weld 32, walls 12, 14 are severed except at regions 34, such that body 30 of successive containers can be separated, by rupturing or tearing of regions 34; successive containers then being connected only at sleeve 24. However, when so separated, successive containers can be completely separated by a longitudinal cut formed between seams 26*a*, 26*b* which passes through seam sections 26*c* and across inlet 28, and by rupturing of walls 12, 14 at region 36 between seams 32*a*, 32*b*.

Inlet 28 provides communication between sleeve 24 and body 30. Access to inlet 28 is had by an opening 38 in the top edge of sleeve 24. In normal use of the containers, body 30 is filled prior to separation of a filled container from the next adjacent container. A seal then is formed by heat sealing across inlet 28, between respective seams 26*a*, and a filled and sealed container then can be separated as described.

Figure 3:
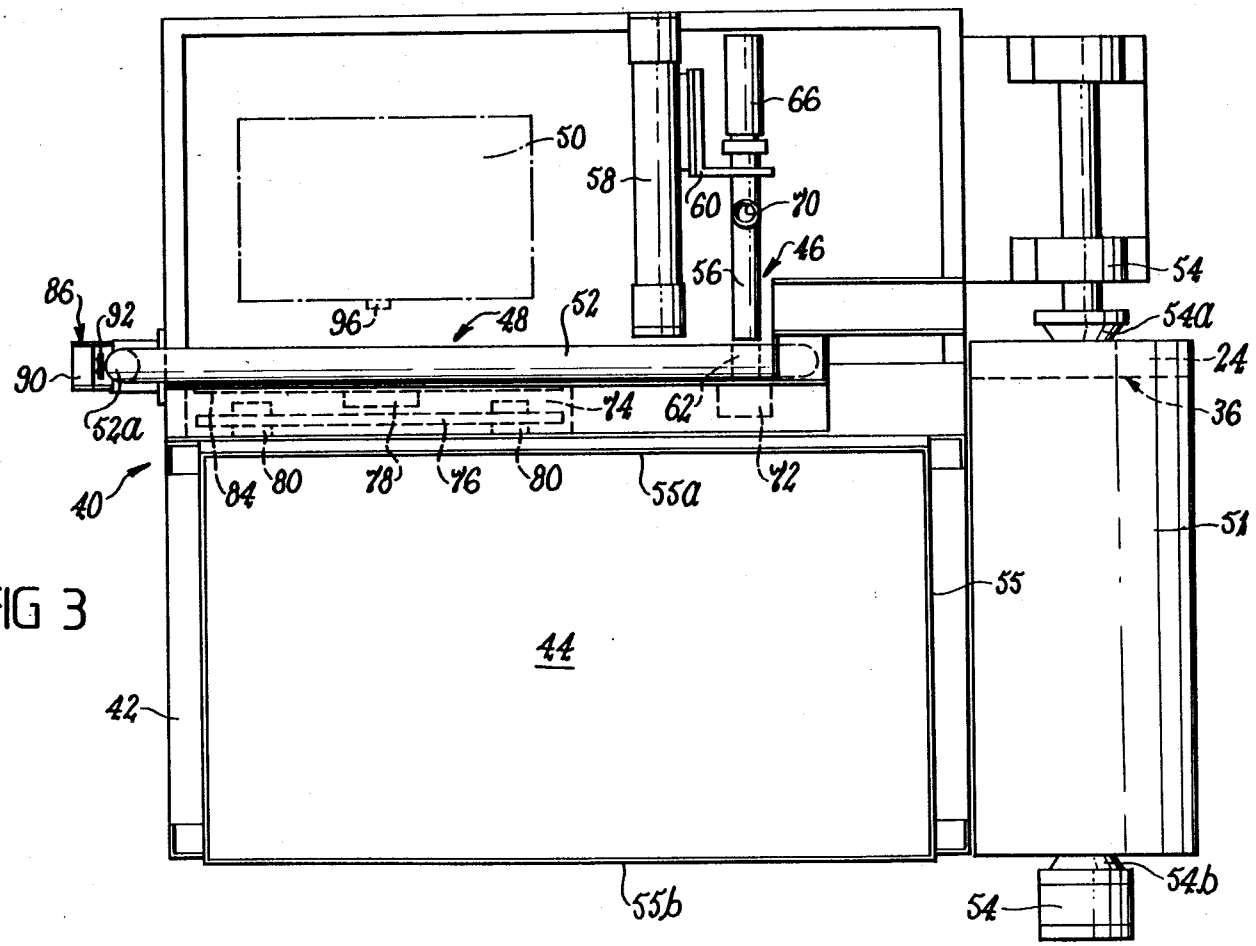
FIGS. 3 to 5 show a first form of apparatus in plan view from above, a front elevation and an end elevation, respectively.
Figure 5:
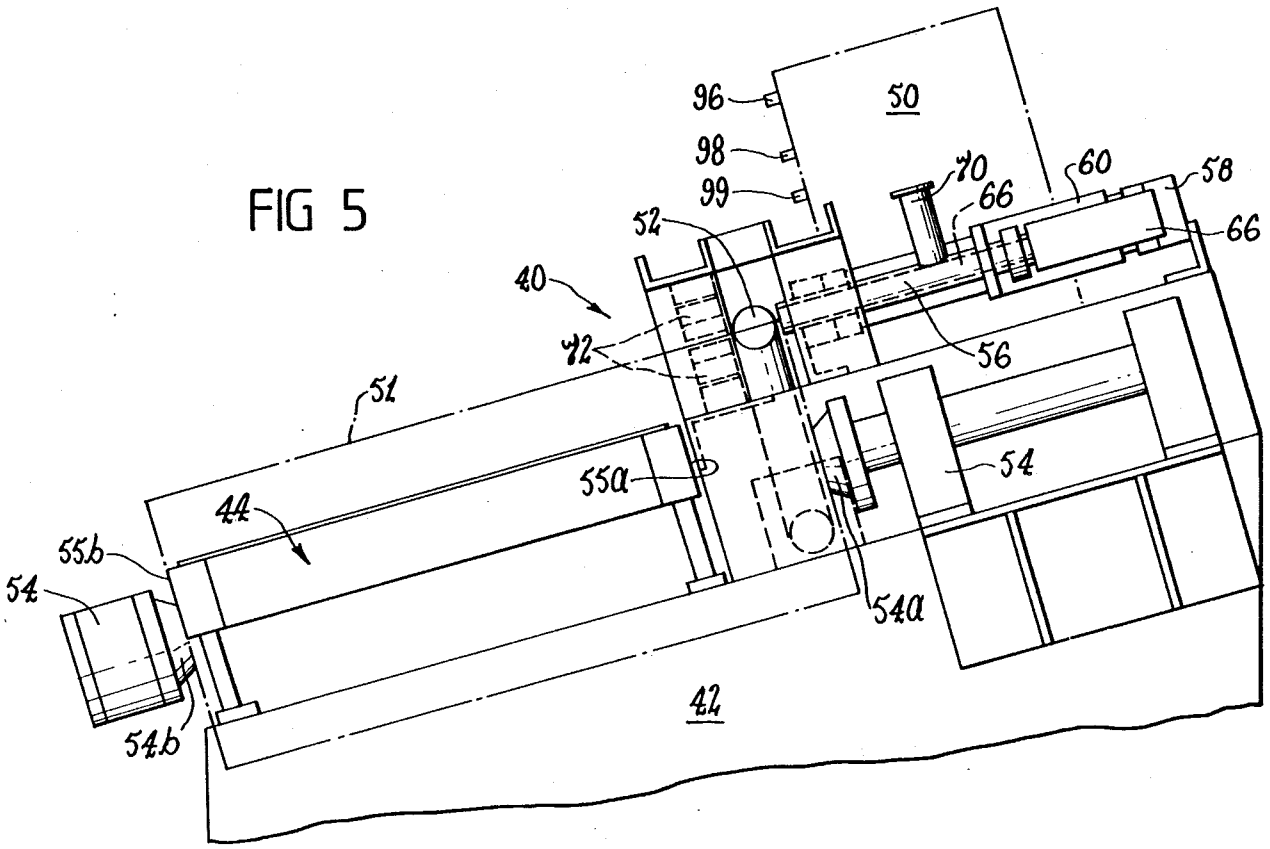

With reference to FIGS. 3 and 5, the apparatus 40 shown therein is suitable for filling, sealing and separating containers such as shown in FIG. 1 or 2. A chain of containers is formed into a supply roll 51. As will be appreciated from the following, apparatus 40 is well suited for use with containers of different capacities. For this, a constant container width most conveniently is used; the container of FIG. 1 having about twice the capacity of that of FIG. 2, due to each being of the same width but different depth. However, it also will be appreciated from the following that the apparatus readily can be modified for use with containers of different width.

Apparatus 40 has a stand 42 on which is provided a support platform 44, filling station 46, sealing station 48, control unit 50 and a mandrel 52. Stand 42 is rectangular or square in plan view, with stations 46, 48 spaced across the rear thereof. Platform 44 extends from end to end of stand 42 and forwardly of stations 46, 48, while mounting means 54 for roll 51 is provided at the end of stand 42 adjacent filling station 46.

Platform 44, in extending forwardly from stations 46, 48 also is inclined downwardly. Containers, such as shown in FIG. 1 or 2, can be drawn from roll 51, along platform 44 toward the remote end of stand 42, with the opening of each container passing adjacent stations 46, 48 and at a higher level than the body of the container, to facilitate filling and sealing.

Mandrel 52 extends from the remote end of stand 42, toward the other end. At the remote end, mandrel 52 has a down-turned C-section 52*a* by which it is mounted on stand 42. The other end of mandrel 52 terminates between station 46 and mounting means 54 for roll 51. The positioning of mandrel 52 is such that on drawing containers from roll 51, across platform 44 toward the other end of stand 42, the sleeve means 24 of the chain of containers can be received on and passed along mandrel 52, with the body of the containers extending forwardly and downwardly on platform 44.

Filling station 46 includes a filler head having a filling nozzle 56 mounted on a rodless cylinder 58 fixed on stand 42. Nozzle 56 is secured to the piston of cylinder 58 by a bracket 60, and extends forwardly perpendicular to mandrel 52. On actuation of cylinder 58, nozzle 56 can be moved between a retracted position as shown, rearward of mandrel 52, and an advanced or filling position in which its discharge end extends through a transverse bore 62 in mandrel 82. With a container guide sleeve received on mandrel 52 so that inlet 28 and opening 38 of the container are respectively aligned with the forward and rearward end of bore 62, the nozzle can be moved to its filling position for discharge of material into the body of the container.

Nozzle 56 has an outlet 64 and encloses a piston 66; the latter being the rod of pneumatic cylinder 68 mounted rearwardly of nozzle 56. Operation of cylinder 68 permits axial movement of piston 66 between an extended piston in which is closes outlet 64 against discharge of material, and a retracted position in which outlet 64 is open for discharge of material. With piston 66 retracted, outlet 64 is in communication with supply duct 70 which is connectable to a source of supply of the material with which containers are to be filled.

Station 46 also includes, forwardly of mandrel 52, a pair of vertically spaced gripping blocks 72. The latter are mounted on stand 42 and movable between a retracted position and closed position. In the closed position, blocks grip a container inlet against the forward end of nozzle 56 when the latter is in its filling position. Blocks 72 may have resilient gripping pads, such as of rubber. Blocks 72 may be movable between their retracted and closed positions by operation of a cam and return spring, or by other suitable actuator such as a pneumatic or hydraulic ram.

Sealing station 48 is located forwardly of mandrel 52. Station 48 includes upper fixed block 74, lower gripping block 76 and a constant heat welding block 78. On movement of a container from station 46 to station 48, the inlet is positioned below block 74 and above blocks 76, 78. Pneumatic or hydraulic lifts 80 then are actuated to lift block 76 to grip the container between the latter and block 74, adjacent to mandrel 72. Similar lift 82 then is actuated to lift block 78 to grip the container across its inlet between block 78 and block 74, and form a heat seal across the opening; block 78 being relatively narrow and, with block 74, gripping the container between block 76 and the mandrel, to enable the seal to be formed close to mandrel 52. Lift 82 then retracts block 78 and, after cooling of the weld, lifts 80 retract block 76 to release the container.

Station 48 also includes an elongate cut-off member 84 which extends parallel to mandrel 52 and has a length equal to the width of containers being filled and sealed. Member 84 is connected to block 78 and is raised and lowered with the latter under the action of lift 82. Member 84 may be a bar which is heated to sever the container from its guide member. Alternatively, member 84 may be a mechanical cutting blade.

When a filled container is sealed, and released from blocks 74, 76, it is attached to the next container to be sealed only along the adjacent sides. Where the sides are connected only by regions 34, 36 (FIGS. 1 and 2), the weight of the filled and sealed container will cause it to move under gravity down the incline of platform 44. This action ruptures or tears regions 34, 36, thereby separating that container.

Once the second of successive containers is presented to station 48, the portion of the guide sleeve of the first container will have passed beyond that station. That guide sleeve portion will continue to encircle mandrel 52 unless the action of member 84 cuts the guide sleeve. However, a cutting blade preferably is provided on the mandrel 52 just prior to the C-section 52*a* of the latter; the blade slitting the guide sleeve longitudinally on being drawn thereover. The guide sleeve then falls from the mandrel and can be used in providing indexed movement of subsequent containers of the chain.

Below C-section 52*a*, the apparatus includes container chain progressing means 86. The latter comprises a rodless cylinder 88 having mounted on its piston a releasable gripping member 90. Operation of cylinder 88, to raise member 90 to an upper extreme position, moves the latter to a position in which the slit guide sleeve can be gripped between actuator head 92 and plate 94. Operation of cylinder 88 to lower member 90 draws the guide sleeve along mandrel 52, providing indexed movement of the chain of containers on platform 44. Retraction of head 92, when member 90 is at a lower extreme position, releases the guide sleeve, enabling member 90 to be raised again to repeat the cycle. Extension and retraction of head 92 may be controlled by a solenoid energized or de-energized on movement of the piston of cylinder 88 to its respective extreme positions.

Operation of the apparatus necessitates initial manual operation, but thereafter can proceed automatically under the operation of control unit 50. Roll 41 of containers is provided at mounting means 54 and a first container is manually presented to station 46 by drawing out the roll. Means 54 has respective centres 54*a*, 54*b* which enable rotation fo roll 41 and positioning of the latter axially such that the guide sleeve, such as sleeve 24, of the containers is aligned with mandrel 52. In presenting the first container to station 46, its portion of guide sleeve 24 is engaged on mandrel 52 and its inlet is positioned to receive nozzle 56. The first container is filled by manually depressing "fill" button 96 of unit 50, causing the latter to actuate components for filling. Thus unit 50 actuates cylinder 58 to move nozzle 56 to its filling station, then the actuator controlling blocks 72 to grip the container inlet on nozzle 56, and then operation of cylinder to retract piston 66 to open outlet 64. After a predetermined quantity of material is charged to the container, as monitored by unit 50, the latter reverses those operations to releaase the filled container.

Next, the filled container is presented manually to station 48, with its inlet located over welding block 78. The "seal" button 98 then is manually depressed, causing unit 50 to actuate components for sealing. Thus unit 50 actuates lifts 80 to raise block 74 to grip the container between blocks 72 and 74, and then actuates lift 82 to raise block 78 to grip the container against block 72 and form a seal across the container inlet. Raising block 78 also raises member 84 and the latter separates the container from its guide member. Unit 50 then reverses those operations; the filled and sealed container then moving down platform 44 and separates from the next container.

The portion of the guide sleeve of the filled, sealed and separated container then is manually moved beyond station 48 on mandrel 52. Before able to pass around section 52*a*, the guide sleeve passes over a blade on mandrel 52 and is slit longitudinally so as to be freed from the mandrel. The slit guide sleeve is manually inserted into gripping member 90 of cylinder 88, with member 90 in its upper position, and "progression" button 99 of unit 50 is depressed. Unit 50 then actuates means 88, causing head 92 to grip the slit guide sleeve and moving member 90 to its lower position, drawing down the guide sleeve.

On manual movement of the first container to station 48, a second container is presented to station 46 and is filled automatically by unit 50. On drawing down of the guide sleeve of the first container by cylinder 88 the filled second container is presented to station 48 and a third container is presented to station 46 and those containers are automatically sealed and filled, respectively, by the operation of unit 50. Thereafter, successiver containers are filled and sealed automatically by that operation. However, a container filled at station 46 most conveniently is not released by blocks 72 of that station until the preceding filled and sealed container separates from the container at station 46, thereby minimising risk of loss of material from the latter station due to movement of the preceding container on separating.

Platform 44 comprises an array of parallel rollers 44*a*, spaced laterally in the direction of container movement. Rollers 44*a* are mounted within peripheral frame 55 of platform 44 and their axes are inclined downwardly from rear edge 55*a* of frame 55, which extends adjacent stations 46, 48, to front edge 55*b* of frame 55. Rollers 44*a* are freely rotatable and provide a conveyor surface on platform 44 which facilitates movement of the chain of containers.

Control unit 50 may provide sequence control by means of microprocessor based electronics. Electronic, as well as pneumatic and/or hydraulic, actuating equipment may be housed within stand 42, below platform 44.

To enable overall operational monitoring by unit 50, a flowmeter and magnetic probe can be provided in duct 70. A signal or pulses generated by the flowmeter/probe is received by unit 50 and, when that signal or aggregate of pulses indicates a predetermined quantity of material has been charged to a container, unit 50 actuates cylinder 68 to close nozzle 56. Also, unit 50 may receive signals from at least one container position indicator sensor; such sensor ensuring, for example, termination of container progression by means 86 when a container is sensed as being correctly positioned at station 46 and/or station 48.

Figure 4:
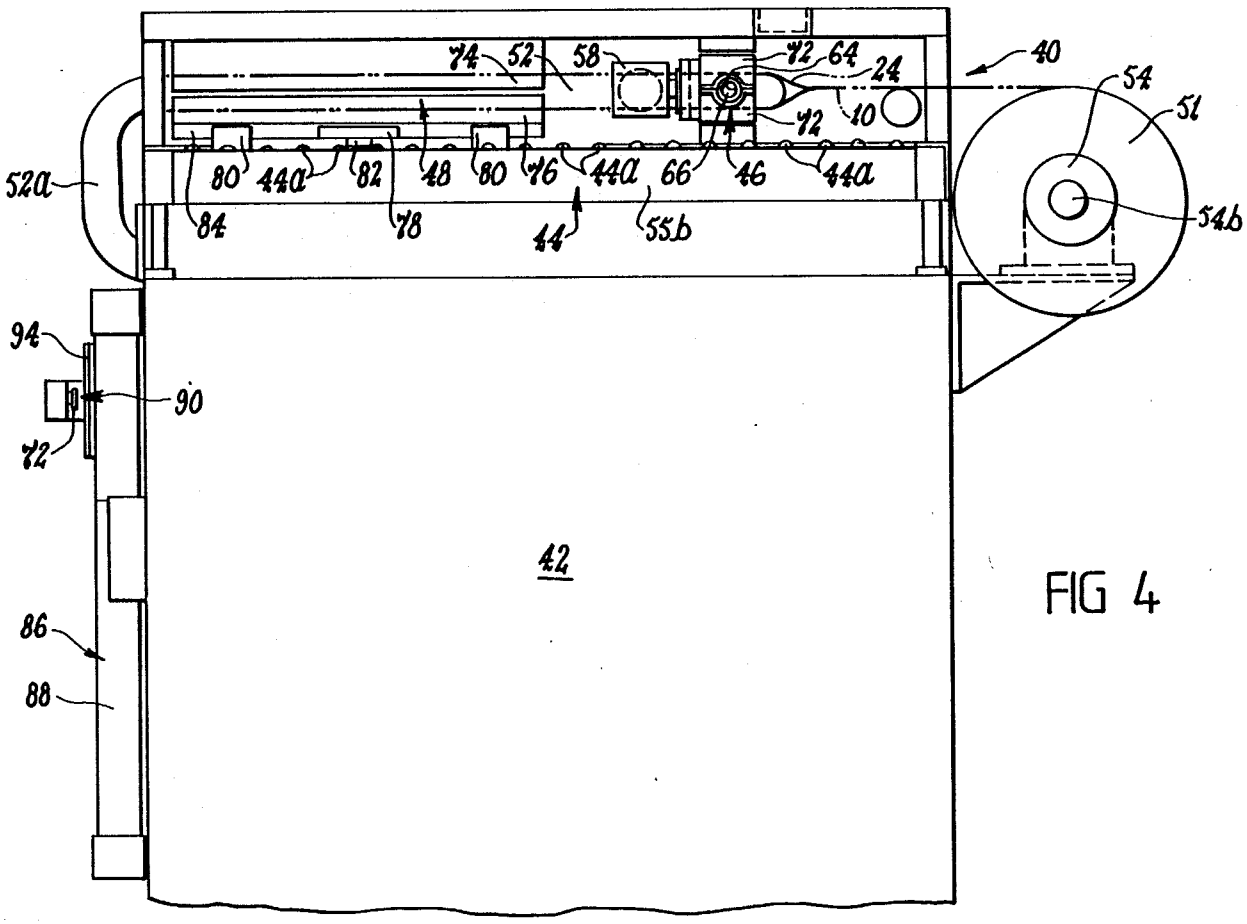
Figure 7:
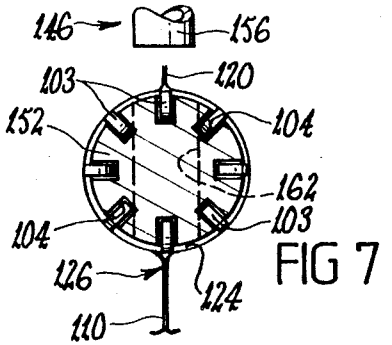
FIG. 7 is a sectional view taken on line VII—VII of FIG. 6.
Figure 6:
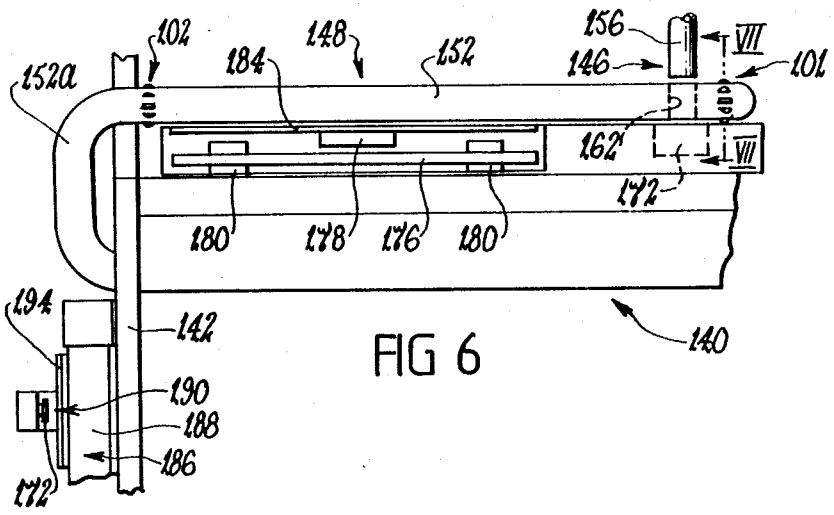
FIG. 6 shows a partial front elevation of a second form of apparatus.

With reference to FIGS. 6 and 7, parts thereof corresponding to those of FIGS. 3 to 5, have the same reference numeral plus 100. As shown the apparatus 140 of Figures 6 and 7 has a stand 142, a filling station 146, sealing station 148, a control unit (not shown but similar in function to unit 50 of FIGS. 3 to 5), and a mandrel 152. While not shown, apparatus 140 further includes mounting means, similar to means 54 of FIGS. 3 to 5, from which a chain of containers such as described in FIGS. 1 or 2 can be drawn so that the guide sleeve thereof can be received on and passed along mandrel 152. However, apparatus 140 is intended for filling the containers while they are suspended from mandrel 152 by the guide sleeve of their chain. For this reason, the support means is oriented so that a roll of a chain of containers retained thereby has its axis extending upwardly. Similarly, apparatus 140 does not include a support platform similar to platform 44 of FIGS. 3 to 5; while the components at filling station 146 operate substantially vertically, rather than laterally, and the components of station 148 are located below, rather than to one side of, mandrel 152.

Mandrel 152 has, at locations spaced along its length, sets 101, 102 of guide rollers 103. As shown, the rollers 103 of each set are located in radially extending pockets 104 spaced circumferentially of and formed in mandrel 152, with each roller 104 projecting slightly outwardly from its pocket, beyond the surface of mandrel 152. Rollers 104 are freely rotatable, and serve to facilitate movement of the guide sleeve along mandrel 152; the inner surface of the guide sleeve riding over the rollers of set 101 adjacent the end of mandrel in passing to station 146, and over the rollers of set 102 on passing from station 148.

At station 148, successive filled and sealed containers separate from their guide means and from the next adjacent container under gravity as previously described. In passing beyond roller set 102, the container guide sleeve may be slit by a cutting blade on mandrel 152, adjacent C-section 152*a* of the latter. Operation of progressing means 186, as previously described, draws the slit guide sleeve and provides indexed movement of the chain of containers along mandrel 152, facilitated by roller sets 101, 102. Overall operation of apparatus 140 otherwise may be as described in relation to apparatus 40.

Figure 9:
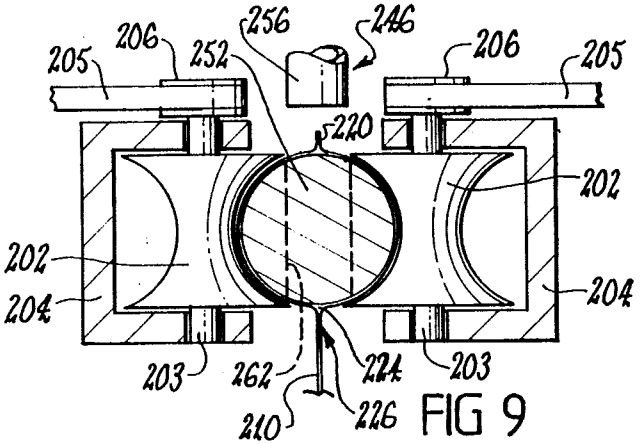
FIG. 9 is a sectional view taken on line IX—IX of FIG. 8.
Figure 8:
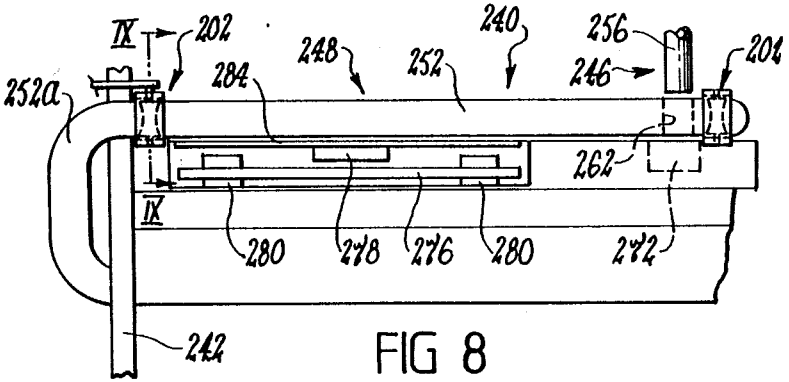
FIG. 8 is a partial front elevation of a third form of apparatus.

The arrangement of FIGS. 8 and 9 is similar to that of FIGS. 6 and 7 and corresponding parts have the same reference numberal plus 100. Apparatus 240 of FIGS. 8 and 9 does not include progressing means (means 186 in FIG. 6). Also, the roller sets 101, 102 are replaced by respective pairs of rollers 201, 202. As seen most clearly in FIG. 9, mandrel 252 extends between rollers 201; while each of the latter has a concave rolling surface complementary to the cylindrical surface of mandrel 252. Rollers 202 have stub axles 203 located in support members 204, and are rotatable by drive belts 205 and pulley wheels 206. The arrangement for rollers 201 may be similar, although these may be freely rotatable rather than driven.

As for apparatus 240, the guide sleeve 224 of the chain of containers is received on and passes along mandrel 252. The drive to rollers 202 is intermittent so that the guide sleeve and containers attached thereto are indexed along mandrel 252 by frictional engagement of rollers 202 on sleeve 224, to station 246 and thereafter to station 248. Filled and sealed containers separate under gravity from the guide sleeve at station 148. The guide sleeve is slit at or adjacent rollers 201, such as by means of a blade on mandrel 252, at or adjacent rollers 201; the slit guide sleeve then discharging from mandrel 252. Again, operation of apparatus 240 otherwise may be described with reference to FIGS. 3 to 5.

At least one set of guide rollers, similar to sets 101, 102 of FIGS. 6 and 7, can be incorporated in the apparatus of FIGS. 3 to 5. Thus, mandrel 52 of FIGS. 3 to 5 may, for example, have such set of rollers for guiding the chain of containers to filling station 46 or beyond that station. Also, instead of the apparatus of FIGS. 3 to 5 having progressing means 86, it may have progressing means comprising at least one pair of rollers similar pairs of rollers 201, 202 shown in FIGS. 8 and 9.

In one arrangement, the apparatus of FIGS. 3 to 5 may have a pair of rollers 202 intermediate sealing station 48 and mandrel section 52*a*, and a set of rollers 101 between station 46 and the adjacent end of mandrel 52.

Similarly, the respective set of rollers of FIGS. 6 and 7 and the progressing means comprising pairs of rollers of FIGS. 8 and 9 can be used in combination in an overall form of apparatus as shown in those Figures. Thus, for example, the pair of rollers 201 of FIGS. 8 and 9 can be replaced by at least one set of rollers mounted in mandrel 252 in the manner of sets 101, 102 of FIGS. 6 and 7.

Finally, it is to be understood that various alterations, modifications and/or additions may be introduced into the constructions and arrangements of parts previously described without departing from the spirit or ambit of the invention.

The claims defining the invention are as follows:

1. Apparatus for filling a chain of successively connected bag containers, each container of the chain being closed at its bottom end, with successive containers being joined at adjacent side edges at which each is sealed by a seam along a major portion of the height thereof, the chain of said containers defining sleeve means along the upper edge thereof, above said side seams; said apparatus comprising:

(a) means for moving said chain of containers along a process line, from a source thereof to a discharge point, with said sleeve means uppermost;

(b) a filling station at a first location along said process line, said filling station having a filling head opeable to charge flowable material received from a source thereof, from a filling nozzle of said filling head, into successive containers presented to said filling station;

(c) a sealing station at a second location along said process line, which second location is intermediate said first location and said discharge point, said sealing station having sealing means for sealing the top of each filled container presented thereto after movement of said container from said filling station; and (d) a mandrel extending along said process line and onto which said sleeve means is receivable, said mandrel having a transverse bore located at said filling station;

said moving means being operable to index said chain of bags along said process line, and said discharge nozzle being movable, in synchronsim with indexed movement of said chain of containers, between an advanced position in which it projects into said transverse bore of the mandrel for filling a container received at said filling station and retracted position.

2. Apparatus according to claim 1, wherein said nozzle is of elongated tubular form, the nozzle having a plunger movable axially therein between a position in which it closes an outlet of the nozzle and a retracted position clear of that outlet to permit discharge of liquid.

3. Apparatus according to claim 2, wherein at least one of said plunger and said nozzle is movable between its respective positions under the action of a fluid extendable and contractable actuator.

4. Apparatus according to claim 1, wherein said nozzle when in its advanced position projects through the bore of the mandrel, the apparatus further including gripping means for engaging walls of the body of successive containers and thereby securing each container in turn in relation to the nozzle.

5. Apparatus according to claim 1, further including means for supporting the body of successive containers of said chain as said containers pass from the filling station to the sealing station.

6. Apparatus according to claim 5, wherein said support means comprises a platform which extends downwardly and away from said stations.

7. Apparatus according to claim 6, wherein said platform is a roller tray having a support surface thereof defined at least in part by a plurality of rollers, said rollers being in substantially parallel relation and laterally spaced from each other along said process line, said rollers having their axes of rotation inclined downwardly and away from said filling and sealing stations.

8. Apparatus according to claim 6, wherein said nozzle is movable between its advanced and retracted positions along a line substantially parallel to said platform such that, on movement to its advanced position, the nozzle projects into said bore from a side of the mandrel remote from the support means.

9. Apparatus according to claim 1, wherein said chain of containers is movable along said process line under the action of said moving means such that successive containers at said filling and sealing stations are supported by said sleeve means being received on said mandrel, said containers at said stations depending from the mandrel.

10. Apparatus according to claim 9, wherein said nozzle is movable between its advanced and retracted position along a line above said mandrel such that, on movement to its advanced position, the nozzle projects into said bore from above the mandrel.

11. Apparatus according to claim 1, wherein said sealing means comprises a welding block and a pressure block, said blocks being relatively movable between a retracted position in which the inlet of successive containers is receivable therebetween, and a closed position for effecting a heat sealing operation across that inlet.

12. Apparatus according to claim 1, wherein said sealing means comprises a first pressure block and a welding block in opposed relation and, adjacent the welding block, a second pressure block; the first and second pressure blocks being movable from a retracted position to a closed position in which they grip a container received therebetween adjacent the inlet of the container, the welding block then being movable to a closed position relative to the first pressure block for forming a weld seal across said inlet, after which the weld block is retractable and on cooling of the weld seal the pressure blocks are retractable.

13. Apparatus according to claim 1, wherein means for separating said sleeve means from successive filled and sealed containers and for longitudinally slitting said sleeve means is located adjacent said mandrel at a position beyond the sealing station from the filling station.

14. Apparatus according to claim 1, including means for separating said sleeve means from successive filled and sealed containers and for longitudinally slitting said sleeve means, said means for moving said chain of containers along said process line comprising a linear actuator movable between an advanced position in which gripping means thereof is operable to grip said slit sleeve means and a retracted position, the actuator being operable to draw the sleeve means on movement to its retracted position, after which said gripping means is operable to release said sleeve means.

15. Apparatus according to claim 1, wherein said means for moving said chain of containers comprises at least one friction roller positioned to frictionally engage said sleeve means on the mandrel, the friction roller being intermittently rotatable by drive means to index said chain of containers along said process line; the apparatus further including means for separating said sleeve means from successive filled and sealed containers, and for slitting said sleeve means longitudinally so as to enable the sleeve means to pass from the mandrel.

16. A method of filling a chain of successively connected bag containers, each container of the chain being closed at its bottom end, with successive containers joined at adjacent side edges at which each is sealed by a seam along a major portion of the height thereof, the chain of said containers defining sleeve means along the upper edge thereof, above said side seams; said method comprising drawing said containers from a source thereof, for indexed movement along a process line, with said sleeve means uppermost; causing said sleeve means to be received onto a mandrel extending along said process line; moving said chain of containers along said process line so that said sleeve means moves along said mandrel, to present each container in turn by indexed movement to a filling station at which a container filling operation is performed and, thereafter, to a sealing station at which a container sealing operation is performed; wherein flowable material from a source thereof is supplied to a filling head at said filling station and a quantity of said material is charged to each of successive containers presented to that station by moving a filling nozzle of said filling head, from a retracted position, to an advanced position in which the nozzle projects into a transverse bore through said mandrel, and discharging said quantity of material into the container.

17. A method according to claim 16, wherein discharging said material to each container is controlled by moving a plunger axially in said nozzle between a position in which is closes an outlet of the nozzle and a retracted position clear of that outlet to permit discharge of the material.

18. A method according to claim 16, wherein said nozzle is moved to its advanced position so as to project through the bore of the mandrel, and walls of the body of successive containers is secured in turn in relation to the nozzle by gripping means engaging said walls.

19. A method according to claim 16, wherein the body of successive containers of said chain is supported on support means as said containers pass from the filling station to the sealing station.

20. A method according to claim 19, wherein said support means comprises a platform on which the body of each container is caused to extend downwardly and away from said stations.

21. A method according to claim 20, wherein the body of each container is moved on a plurality of rollers from said filling to said sealing station.

22. A method according to claim 20, wherein said nozzle is moved between its advanced and retracted positions along a line substantially parallel to said platform such that, on movement to its advanced position, the nozzle projects into said bore from a side of the mandrel remote from the support means.

23. A method according to claim 16, wherein said chain of containers is moved along said process line under the action of moving means such that successive containers at said filling and sealing stations are supported by said sleeve means being received on said mandrel, said containers at said stations depending from the mandrel.

24. A method according to claim 23, wherein said nozzle is moved between its advanced and retracted position along a line above said mandrel such that, on movement to its advanced position, the nozzle projects into said bore from above the mandrel.

25. A method according to claim 16, wherein said sealing is performed by a welding block and a pressure block, said blocks being relatively moved between a retracted position in which the inlet of successive containers is received therebetween, and a closed position for effecting a heat sealing operation across that inlet.

26. A method according to claim 16, wherein said sealing is performed by a first pressure block and a welding block in opposed relation and, adjacent the welding block, a second pressure block; the first and second pressure blocks being moved from a retracted position to a closed position to grip a container received therebetween adjacent the inlet of the container, the welding block then being moved to a closed position relative to the first pressure block to form a weld seal across sain inlet, after which the weld block is retracted and on cooling of the weld seal the pressure blocks are retracted.

27. A method according to claim 16, wherein said sleeve is separated from successive filled and sealed containers and is longitudinally slit at a position adjacent said mandrel and beyond the sealing station from the filling station.

28. A method according to claim 16, wherein said sleeve means is separated from successive filled and sealed containers and longitudinally slit, said chain of containers being moved along said process line by a linear actuator movable between an advanced position in which it grips said slit sleeve means and a retracted position, the actuator being operated to draw the sleeve means on movement to its retracted position, after which said gripping means releases said sleeve means.

29. A method according to claim 16, wherein said chain of containers is moved by at least one friction roller frictionally engaging said sleeve means on the mandrel, the friction roller being intermittently rotated by drive means to index said chain of containers along said process line; said sleeve means being separated from successive filled and sealed containers slit longitudinally so that the sleeve means passes from the mandrel.

* * * * *